US006241596B1

(12) United States Patent
Osterheld et al.

(10) Patent No.: US 6,241,596 B1
(45) Date of Patent: Jun. 5, 2001

(54) METHOD AND APPARATUS FOR CHEMICAL MECHANICAL POLISHING USING A PATTERNED PAD

(75) Inventors: Thomas H. Osterheld, Mountain View; Hung Chih Chen, San Jose; Erik Rondum, San Ramon, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/483,790

(22) Filed: Jan. 14, 2000

(51) Int. Cl.[7] ..... B24D 11/00
(52) U.S. Cl. ..... 451/527; 451/41; 451/526
(58) Field of Search ..... 451/41, 57, 527, 451/283, 450, 446, 285, 287, 537, 530, 548

(56) References Cited

U.S. PATENT DOCUMENTS 3,991,527 * 11/1976 Maran ..... 451/529
5,216,843 6/1993 Breivoge et al. ..... 51/131.1
5,605,760 2/1997 Roberts ..... 428/409
5,645,469 * 7/1997 Burke et al. ..... 451/283
5,650,039 7/1997 Talieh ..... 156/636.1
5,795,218 * 8/1998 Doan et al. ..... 451/526
5,882,251 3/1999 Berman et al. ..... 451/527
5,921,855 7/1999 Osterheld et al. ..... 451/527
5,984,769 * 11/1999 Bennett et al ..... 451/529

* cited by examiner

*Primary Examiner*—Derris H. Banks
(74) *Attorney, Agent, or Firm*—Thomason, Moser & Patterson

(57) ABSTRACT

A polishing pad for use in a chemical mechanical polishing system is provided. The pad comprises a patterned surface having slurry distribution/retaining grooves formed therein. The slurry distribution/retaining grooves include a uniform or random pattern of non-continuous or obstructed groove segments adapted to inhibit slurry or other fluids from flowing off of the pad during operation.

21 Claims, 7 Drawing Sheets

METHOD AND APPARATUS FOR CHEMICAL MECHANICAL POLISHING USING A PATTERNED PAD

BACKGROUND OF THE INVENTION

1. Field of the Invention

The present invention relates to an apparatus and method for polishing substrates. More particularly, the invention relates to a platen/polishing pad assembly having surface to improve polishing uniformity of substrates.

2. Background of the Related Art

In the fabrication of integrated circuits and other electronic devices, multiple layers of conducting, semiconducting and dielectric materials are deposited and removed from a substrate during the fabrication process. Often it is necessary to polish a surface of a substrate to remove high topography, surface defects, scratches or embedded particles. One polishing process is known as chemical mechanical polishing (CMP) and is used to improve the quality and reliability of the electronic devices formed on the substrate.

In general, the polishing process involves holding a substrate against a polishing pad under controlled pressure, temperature and rotational velocity of the pad in the presence of the slurry or other fluid medium. Typically, the polishing process involves introducing a chemical slurry during the polishing process to facilitate higher removal rates and selectivity between films on the substrate surface. One polishing system that is used to perform CMP is the MIRRA® System available from Applied Materials, Inc.

An important goal of CMP is achieving uniform planarity of the substrate surface. Uniform planarity includes the uniform removal of material from the surface of substrates as well as removing non-uniform layers which have been deposited on the substrate. Successful CMP also requires process repeatability from one substrate to the next. Thus, uniformity must be achieved not only for a single substrate, but also for a series of substrates processed in a batch.

Substrate planarity is determined, to a large extent, by the construction of the CMP apparatus and the composition and construction of the consumables such as the slurry and the pads, all of which contribute to the polishing rate. One factor which contributes to non-uniform polishing is the non-homogeneous replenishment and distribution of slurry at the interface of the substrate and the polishing pad. The slurry is primarily used to enhance the material removal rate of selected materials from the substrate surface. As a fixed volume of slurry in contact with the substrate reacts with the selected materials on the substrate surface, the slurry constituents are consumed.

Non-uniform slurry distribution on the pad results because the inertia of the slurry during the rotation of the pad causes the slurry to flow off of the pad during operation. As a result of the non-uniform slurry distribution on the pad, the substrates being processed experience poor polishing uniformity. Usually, the resulting polishing is "center-slow," meaning that the removal rate of material at the center portion of the substrate is lower than at the outer potion of the substrate. Attempting to compensate for the center-slow polishing effect by increasing the pressure applied to the center portion of the substrate can compromise the planarity of the substrate because the proper properties of pressure are difficult to achieve. In addition, the increased loading pressure of the substrate on the pad also acts to force the slurry out from between the pad and substrate leaving areas on the pad starved of slurry. As a result, the polishing is non-uniform over the surface of the substrate.

One solution to remedy the problem of poor slurry distribution has been to provide grooves in the pad. One grooved pad is the IC 1000 available from Rodel, Inc., of Newark, Del. FIG. 1 shows an X-Y configuration of the grooves formed in the upper polishing surface of the pad. A plurality of the grooves extend parallel to one another in a first direction (X) and a plurality of grooves extend parallel to one another in a second direction (Y), which is orthogonal to the first direction. The result is an X-Y pattern of grooves intersecting one another at right angles. The grooves are believed to control the distribution of the slurry during operation by retaining a portion of the slurry in the grooves. However, while such pad designs accommodate more slurry volume than flat or planar pads, the pads have proved ineffective in achieving uniformity in slurry distribution because the inertia of the slurry causes the slurry to flow radially outward and off of the pad during rotation of the pad.

In an attempt to ensure the uniform distribution of fresh slurry to all areas of the substrate, conventional methods continually supply large volumes of slurry to the pad during a polishing cycle. As a result, slurry is the primary consumable in chemical mechanical polishing and a significant source of the cost of operation. In order to minimize the cost of operation, the volume of slurry used in a processing cycle should be minimized. However, as noted above, conventional pads are not capable of efficiently retaining the slurry between the pad and the substrate. As a result, the volume of consumed slurry is substantially higher than is desirable.

Another problem with the presence of grooves on the polishing surface of a pad is the detrimental effect on the polishing characteristics of the pad. In particular, the grooves decrease the total area available for polishing the substrate, thereby decreasing the removal rate of material from the substrate. Further, the stiffness of the pad can be affected by the grooves. A preferred pad construction allows for a proper balance between rigidity (or stiffness) and compliance (or flexibility) of the polishing pad. In general, stiffness is needed to ensure within-die uniformity which refers to the ability of the CMP apparatus to remove features across the diameter of the substrate regardless of substrate shape and/or topography across its surface. The provision of grooves on the polishing surface can decrease the stiffness of the pad to an unacceptably low level, resulting in poor within-die uniformity.

Therefore, there is a need for a polishing pad capable of controlling slurry distribution over the pad surface and providing uniform and planar polishing.

SUMMARY

The present invention generally provides an apparatus for polishing a substrate which improves the distribution of slurry over the surface of a polishing pad and improves uniformity and planarity of the polishing process. The apparatus is preferably adapted for incorporation into a chemical mechanical polishing system.

In one aspect of the invention, a polishing pad is provided having a patterned upper polishing surface. A plurality of discontinuous or obstructed fluid delivery/retaining grooves is formed on the upper polishing surface and includes a uniform or random pattern of non-continuous or obstructed groove segments adapted to inhibit slurry or other fluids from flowing off of the pad during operation. In one embodiment, obstructions or protrusions are formed on the upper polishing surface. In another embodiment, the groove geometry includes a series of sharp turns adapted to restrict fluid flow.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally relates to a polishing pad having fluid-retaining grooves formed therein. The grooves are formed on an upper surface of the polishing pad and preferably include a plurality of discontinuous groove segments delimited at their respective ends by protrusions, obstructions or by the geometric shape of the grooves. The protrusions may be portions of pad material which act to retain fluid within the grooves during a polishing cycle.

For clarity and ease of description, the following description refers primarily to a CMP system. However, the invention is equally applicable to other types of processes that utilize a pad and platen assembly for polishing or cleaning a substrate.

Figure 1A:
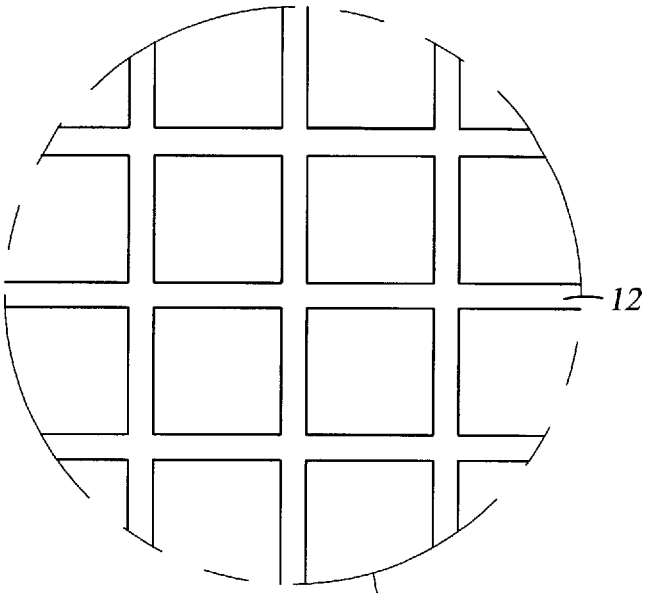
FIG. 1A is a close-up of a portion of FIG. 1.
Figure 1:
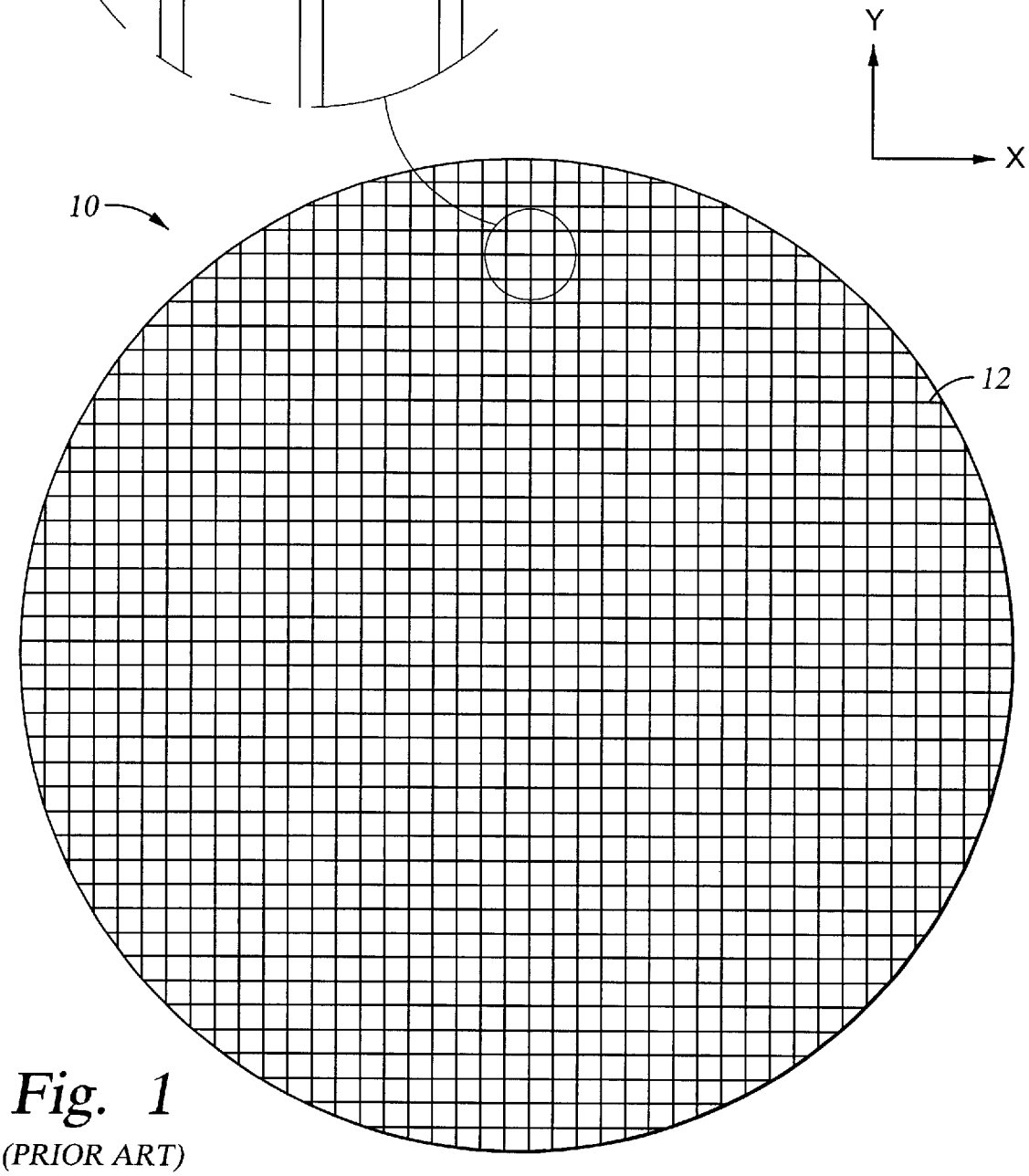
Fig. 1 (PRIOR ART)
FIG. 1 is a top view of a prior art polishing pad having grooves formed in therein.
Figure 2:
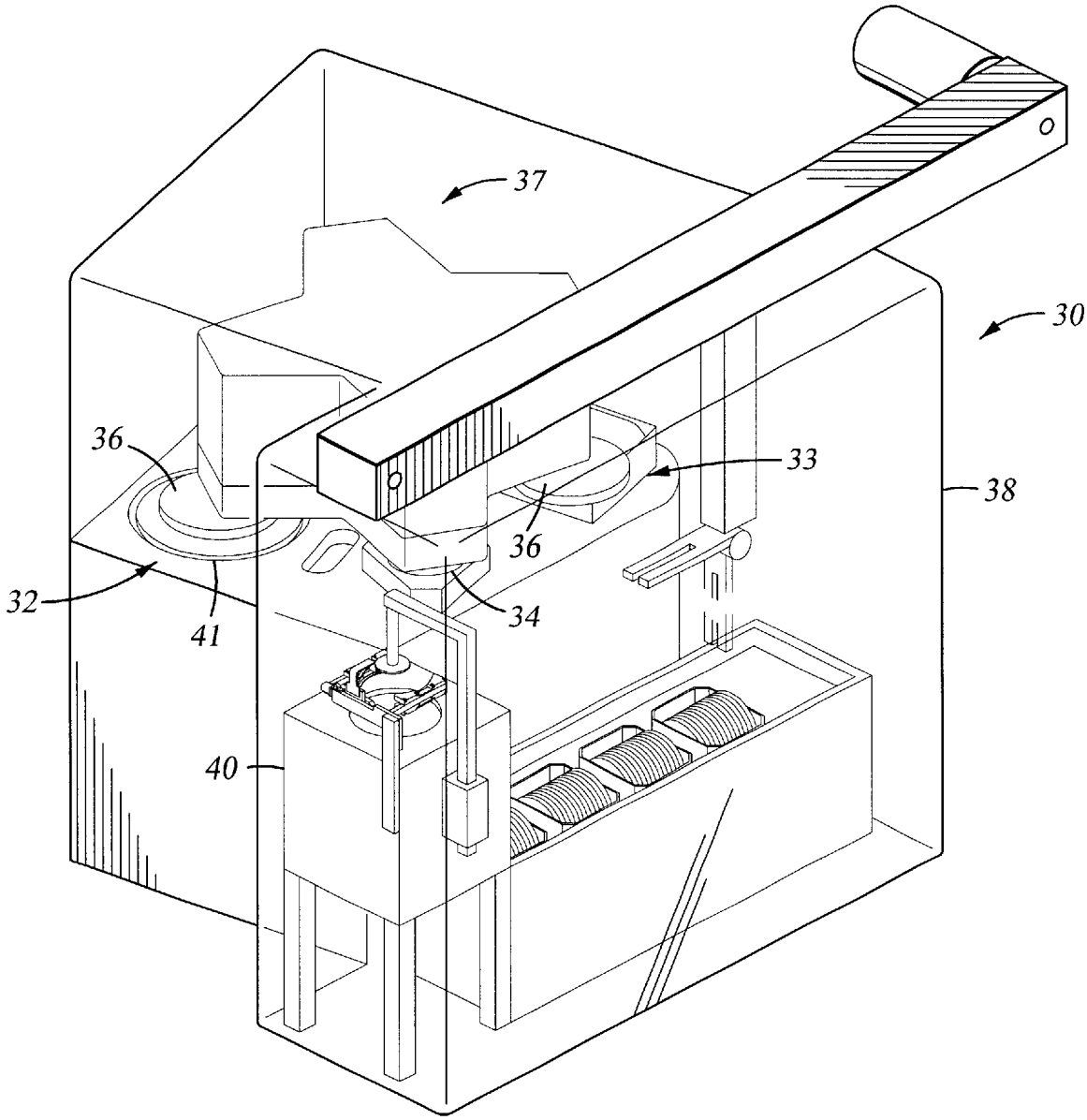
FIG. 2 is a schematic view of a CMP system.

FIG. 2 is a schematic view of a CMP system 30, such as a Mirra® System available from Applied Materials, Inc., located in Santa Clara, Calif. The system shown includes one or more polishing stations 32, 33 and a loading station 34. Preferably, the system 30 includes rotary/orbital polishing stations 32 and as well as linear polishing stations 33. Polishing heads 36 are rotatably mounted to a polishing head displacement mechanism 37 disposed above the polishing stations 32, 33 and the loading station 34. A front-end substrate transfer region 38 is disposed adjacent to the CMP system and is considered a part of the CMP system, though the transfer region 38 may be a separate component. A substrate inspection station 40 is disposed in the substrate transfer region 38 to enable pre and/or post process inspection of substrates introduced into the system 30.

Typically, a substrate is loaded on a polishing head 36 at the loading station 34 and is then rotated through the polishing stations 32, 33. The polishing stations 32 each comprise polishing or cleaning pads mounted thereon. One process sequence includes a polishing pad at two of the stations 32 and a cleaning pad at a third station 32 to facilitate substrate cleaning at the end of the polishing process. At the end of the cycle the substrate is returned to the front-end substrate transfer region 38 and another substrate is retrieved from the loading station 34 for processing.

For brevity, only the rotary polishing station 32 is described in detail below. However, linear polishers (such as the polishing station 33 shown in FIG. 2) and their operation are well known in the art. Further, the invention contemplates the use of any polisher including rotary and linear polishers.

Figure 3:
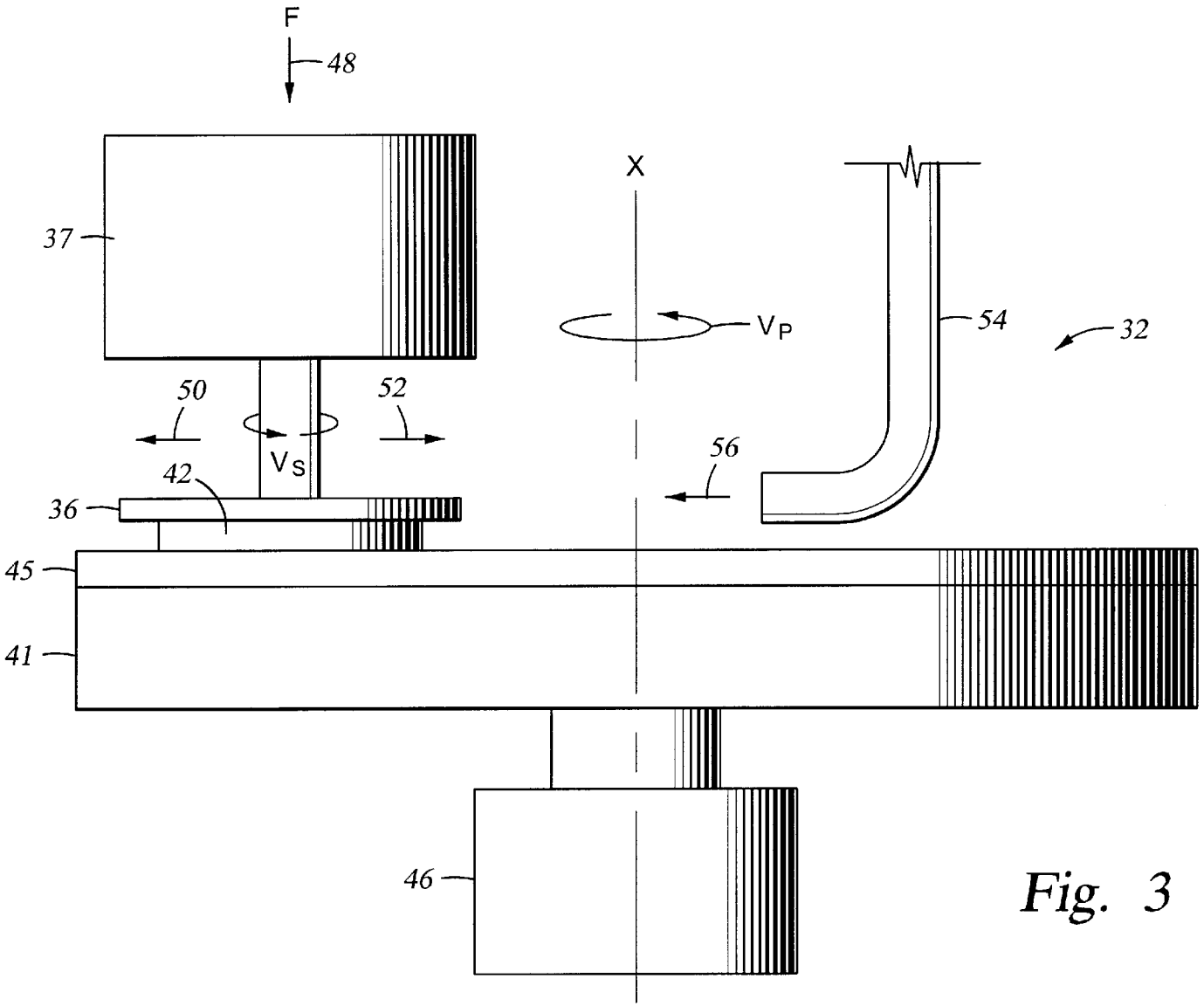
FIG. 3 is a schematic view of a polishing station.

FIG. 3 is a schematic view of a polishing station 32 and polishing head 36 used to advantage with the present invention. The polishing station 32 comprises a pad 45 secured to an upper surface of a rotatable platen 41. The pad 45 may utilize any commercially available pad supplied by manufacturers such as Rodel, Inc., of Newark, Del., and preferably comprises a plastic or foam such as polyurethane. Other pad materials include urethane impregnated polyester felts, microporous urethane pads of the type sold as Politex by Rodel, Inc., and blown composite urethanes such as IC-series and MH-series polishing pads also manufactured by Rodel, Inc. of Newark, Del. Further, the pad 45 may be a composite pad comprising two or more pads secured to one another by an adhesive, for example. The platen 41 is coupled to a motor 46 or other suitable drive mechanism to impart rotational movement to the platen 41. During operation, the platen 41 is rotated at a velocity $V_p$ about a center axis X. The platen 41 can be rotated in either a clockwise or counterclockwise direction.

FIG. 3 also shows the polishing head 36 mounted above the polishing station 32. The polishing head 36 supports a substrate 42 for polishing. The polishing head 36 may comprise a vacuum-type mechanism to chuck the substrate 42 against the polishing head 36. During operation, the vacuum chuck generates a negative vacuum force behind the surface of the substrate 42 to attract and hold the substrate 42. The polishing head 36 typically includes a pocket (not shown) in which the substrate 42 is supported, at least initially, under vacuum. Once the substrate 42 is secured in the pocket and positioned on the pad 45, the vacuum can be removed. The polishing head 36 then applies a controlled pressure behind the substrate, indicated by the arrow 48, to the backside of the substrate 42 urging the substrate 42 against the pad 45 to facilitate polishing of the substrate surface. The polishing head displacement mechanism 37 rotates the polishing head 36 and the substrate 42 at a velocity $V_s$ in a clockwise or counterclockwise direction, preferably the same direction as the platen 41. The polishing head displacement mechanism 37 also preferably moves the polishing head 36 radially across the platen 41 in a direction indicated by arrows 50 and 52.

With reference to FIG. 3, the CMP system also includes a chemical supply system 54 for introducing a chemical slurry of a desired composition to the polishing pad. In some applications, the slurry provides an abrasive material which facilitates the polishing of the substrate surface, and is preferably a composition formed of solid alumina or silica. During operation, the chemical supply system 54 introduces the slurry, as indicated by arrow 56, on the pad 45 at a selected rate. In other applications the pad 45 may have abrasive particles disposed thereon and require only that a liquid, such as deionized water, be delivered to the polishing surface of the pad 45.

Figure 4B:
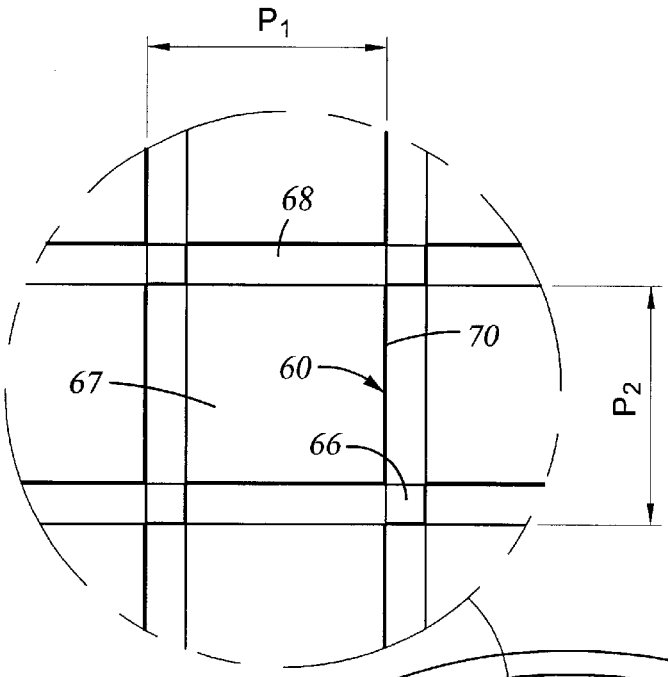
FIG. 4B is a close-up of a portion of FIG. 4A.
Figure 4A:
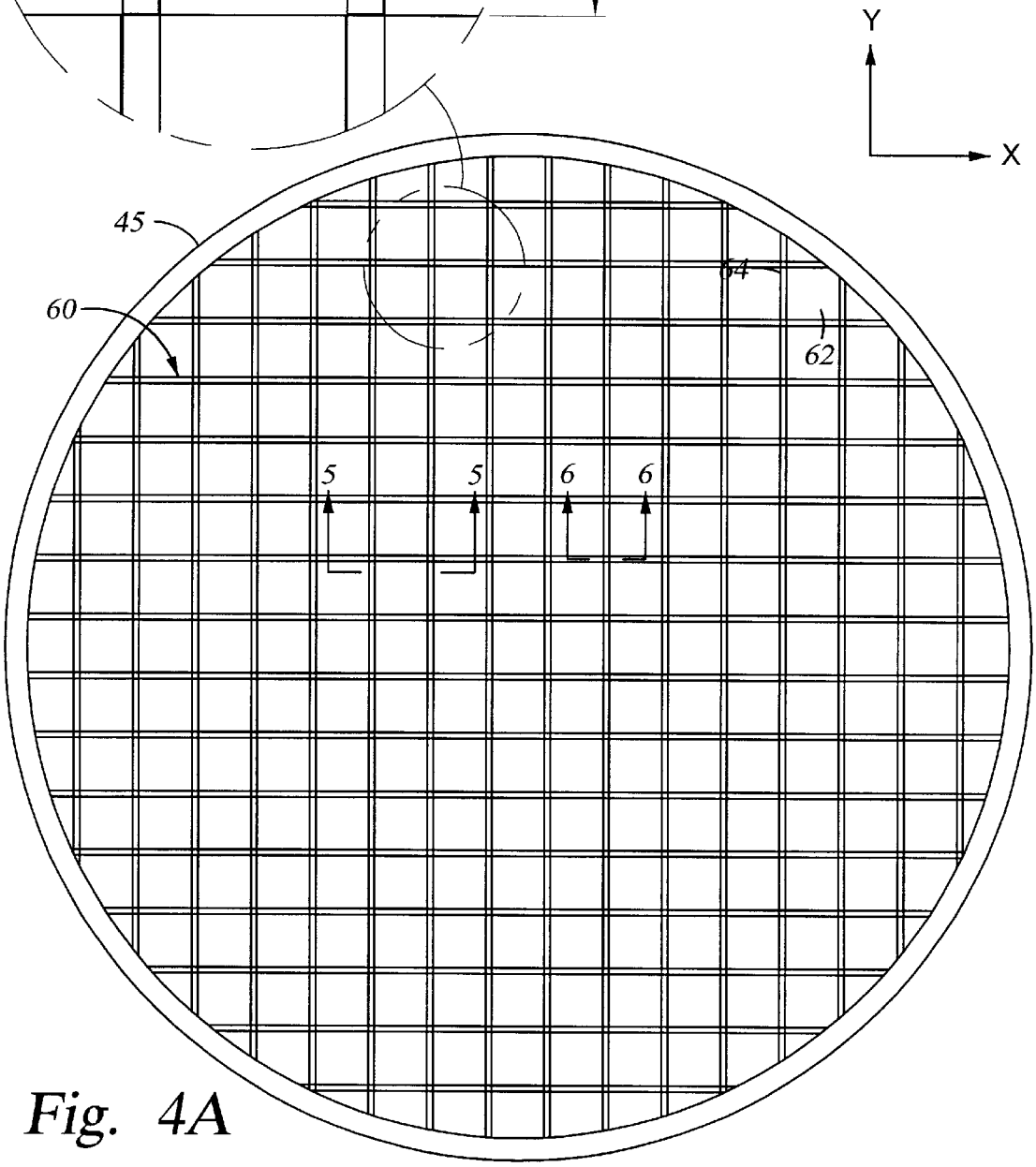
FIG. 4A is a top view of one embodiment of a polishing pad.

FIG. 4A is a top view of one embodiment of a pad 45 and FIG. 4B is a close-up of a portion of FIG. 4A. A plurality of substantially linear grooves 60 are shown disposed on the upper surface of the polishing pad 45. The grooves 60 include a first portion 62 extending linearly over the surface of the pad 45 along an x-axis and a second portion of the grooves 64 extending over the surface of the pad 45 along a y-axis. The relative orientation of the grooves 60 defines an X-Y grid pattern on the polishing pad. The bulk of the polishing surface 67 of the pad 45 is provided by islands 70 defined by the grooves 60. The grooves 60 are discontinuous along their respective lengths. By discontinuous is meant that obstructions are disposed in the grooves 60 to inhibit fluid flow through the grooves 60, or that fluid flow is otherwise inhibited by the geometry of the grooves 60 such as abrupt turns or corners.

As shown in FIG. 4B, a plurality of protrusions 66, or obstructions, disposed along the length of the grooves 60 defines a plurality of groove segments 68. The protrusions 66 may be portions of the pad material which were not milled out during the manufacturing of the grooves 60. Accordingly, the upper surfaces of the protrusions 66 may be co-planar with the polishing surfaces 67, thereby increasing the total surface area of the polishing surface. It is understood that the method of manufacturing the pad 45 and the grooves 60 is not limiting of the invention. Thus, the grooves 60 may alternatively be molded or otherwise shaped by known and unknown techniques and apparatus. Additionally, the protrusions 66 may be separate pieces of material secured along the length of the grooves 50 by an adhesive.

The embodiment illustrated in FIGS. 4A–B provides protrusions 66 at the corners of each island 70, thereby bridging each island 70 to each adjacent island 70 and limiting the groove segments 68 to the width of an island 70. However, as will be explained below with reference to FIGS. 7–9, the density of protrusions 66 can be varied as desired.

Figure 5:
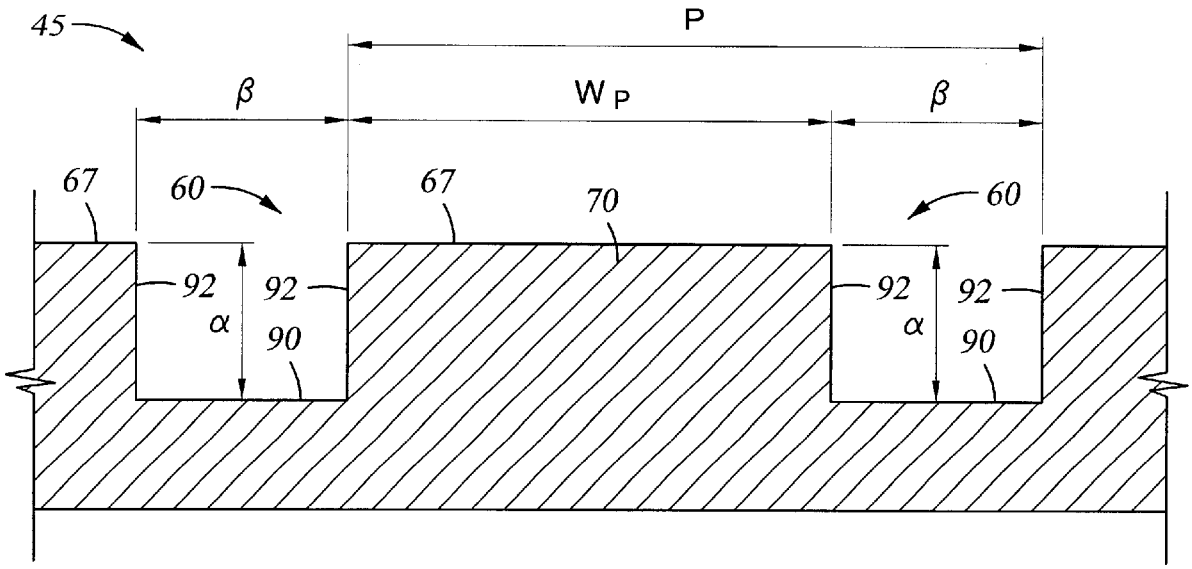
FIG. 5 is a cross-sectional view of the polishing pad of FIG. 4 taken along the section lines 5—5.

FIG. 5 is a cross-section view of the pad 45 and grooves 60 formed therein, taken along section line 5—5 of FIG. 4A. The grooves 60 are defined by a pair of sidewalls 92 and a bottom 90. Although FIG. 5 shows the sidewalls 92 as being substantially parallel to one another and perpendicular to the bottom 90, alternative geometric shapes are contemplated. The groove dimensions are a depth $\alpha$ and a width $\beta$. In one embodiment, the depth $\alpha$ may be between about 5 mils and about 100 mils and the width $\beta$ may be between about 6 mils and about 80 mils. Most preferably, the groove dimensions are about 25 mils×65 mils on a pad 45 having a thickness of about 50 mils or 80 mils.

One limitation on the maximum depth $\alpha$ of the grooves 60 is the impact on the stiffness, or rigidity, of the pad 45. Increasing groove depth $\alpha$ can result in less pad rigidity. Because rigidity affects the polishing quality of the pad 45, the groove depth $\alpha$ should be adjusted to avoid loss of rigidity. On the other hand, the groove depth $\alpha$ should be sufficient to accommodate some degree of wear. Over time, continuous polishing will cause the pad 45 to wear resulting in a decrease in the overall pad thickness and groove depth $\alpha$. Thus, in order to avoid premature replacement of the pad 45, the grooves 60 are sized to provide a sufficient lifetime. The particular groove depth $\alpha$ is dependent on other pad characteristics, e.g., pad composition and construction, which can affect the modulus of elasticity.

While the depth $\alpha$ is preferably constant along the length of the grooves 60, the invention contemplates having tapered or sloped grooves. The angle of inclination can facilitate slurry delivery control as determined by the direction of the inclination. For example, the grooves 60 may have an inclination causing the grooves 60 to become deeper toward the center of the pad 45 to further inhibit the flow of slurry outward toward the edge of the pad 45. In another embodiment, the grooves 60 may have varying and opposite angles of inclination so that well-areas are formed along the length of the grooves 60 which act to collect a higher volume of slurry than at other areas of the grooves 60.

The width of the islands 70 is shown as Wp. In the embodiment shown in FIG. 4, the islands 70 are of equal length (x-axis) and height (y-axis) but other shapes and dimensions are possible. In one embodiment, the polishing surface 67 provided by the islands 70 is between about 0.5 inches$^2$ (or about $5\times10^5$ mils$^2$) and about 2.0 inches$^2$ (or about $2\times10^6$ mils$^2$).

The grooves 60 are shown uniformly spaced with a pitch P, defined as the sum of the width of the islands 70 (Wp) and the width of a groove 60 ($\beta$), i.e., Wp +$\beta$. As shown in FIG. 4, the pitch P1 indicates the distance between the grooves 60 oriented along the y-axis and the pitch P2 indicates the distance between the grooves 60 oriented along the x-axis. In one embodiment, the pitch P between the grooves 60 is between about 713 mils and about 1495 mils.

The ratio of the groove width $\beta$ to the island width Wp is selected to determine the desired stiffness or rigidity of the pad 45 which in turn defines the polishing characteristics of the pad 45. In one embodiment the ratio $\beta$/Wp is between about 0.004 and about 0.113. If the grooves 60 are too wide, the polishing pad 45 will be too flexible resulting in a planarizing effect wherein the high points and the low points of a substrate topology are polished at the same rate. As a result, the total substrate thickness is reduced without planarizing the upper surface thereof On the other hand, if the grooves 60 are too narrow it becomes difficult to remove waste material from the grooves 60 and the islands 70 may not have sufficient local stiffness to independently contribute to the polishing. Similarly, if the pitch P is too small the grooves 60 will be too close together and the polishing pad 45 will be too flexible. If the pitch P is too large, slurry will not be evenly transported to the entire surface of the substrate.

Figure 6:
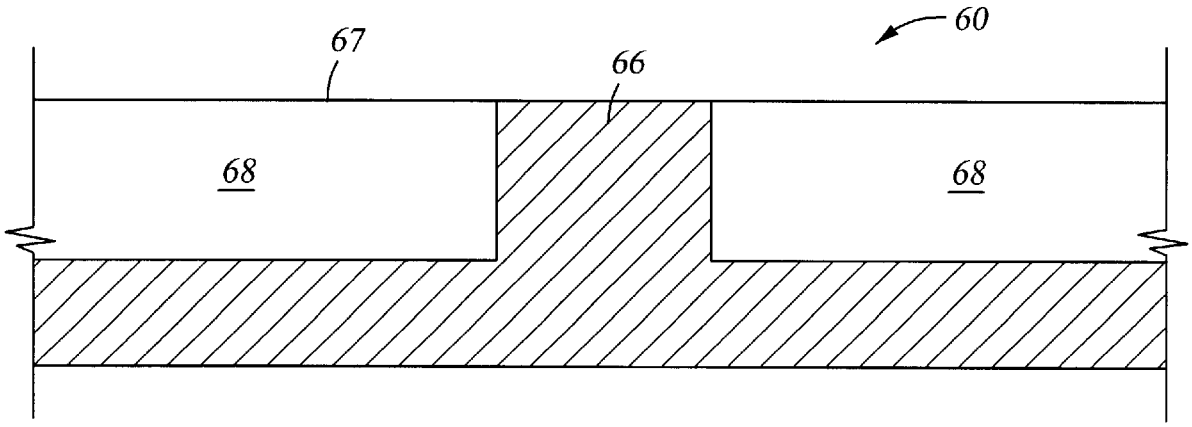
FIG. 6 is a cross-sectional view of the polishing pad of FIG. 4 taken along the section lines 6—6.

FIG. 6 shows a cross-sectional side view of the pad 45, taken along the section lines 6—6 of FIG. 4, showing the groove segments 68 which are separated by the protrusions 66. As noted previously, the protrusions 66 may be a portion of pad material which was not removed during the construction of the grooves 60. As a result, the upper surface of the protrusions 66 is co-planar with the polishing surface 67 of the pad 45. Thus, in addition to defining the groove segments 68 of the grooves 60, the protrusions 66 also increase the total polishing surface area of the pad 45.

In operation, slurry is provided to the upper surface of the pad 45. A substrate is then brought into contact with the pad 45 to enable polishing of the substrate surface. Due to the grooves 60 formed on the surface of the pad 45, the residence time of the slurry on the pad 45 is increased. In particular, the presence of the protrusions 66 eliminates an unobstructed flow path and inhibits the flow of slurry outward toward the edge of the pad 45. Accordingly, the residence time of the slurry on the pad is increased and the slurry is more efficiently consumed before flowing off of the pad 45. Thus, the total volume of slurry consumed during a polishing cycle can be reduced.

Figure 7:
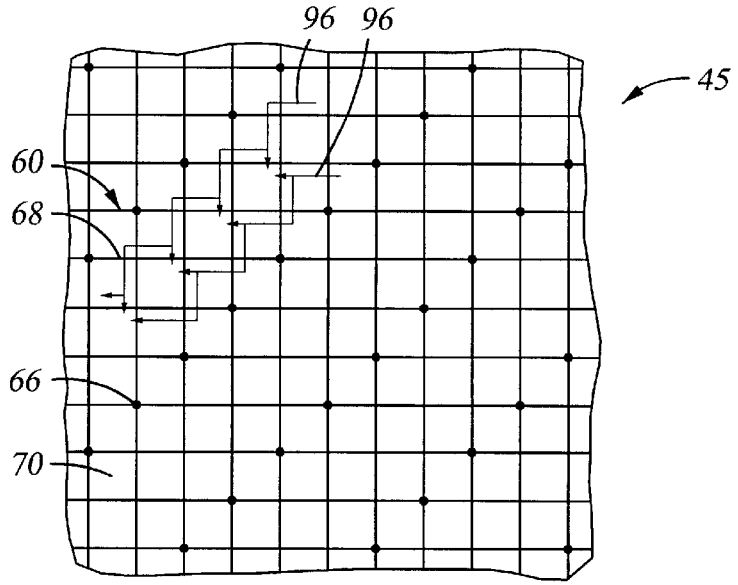
FIG. 7 is a top view of another embodiment of a polishing pad.
Figure 8:
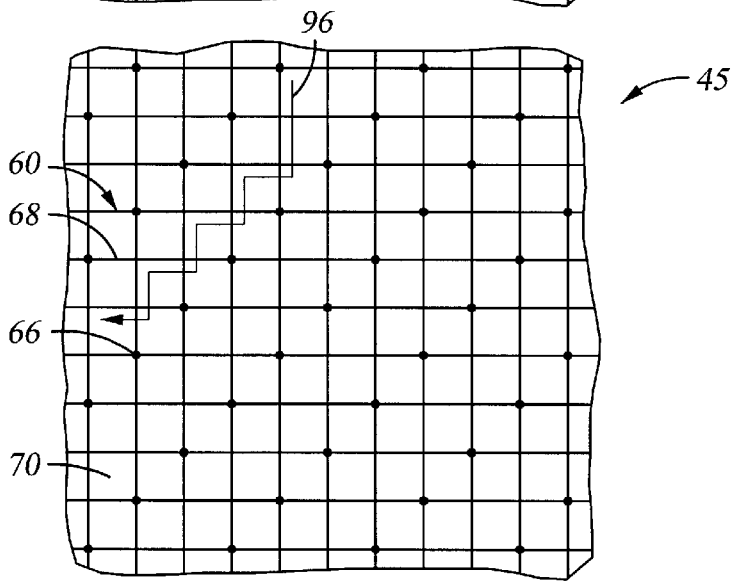
FIG. 8 is a top view of another embodiment of a polishing pad.
Figure 9:
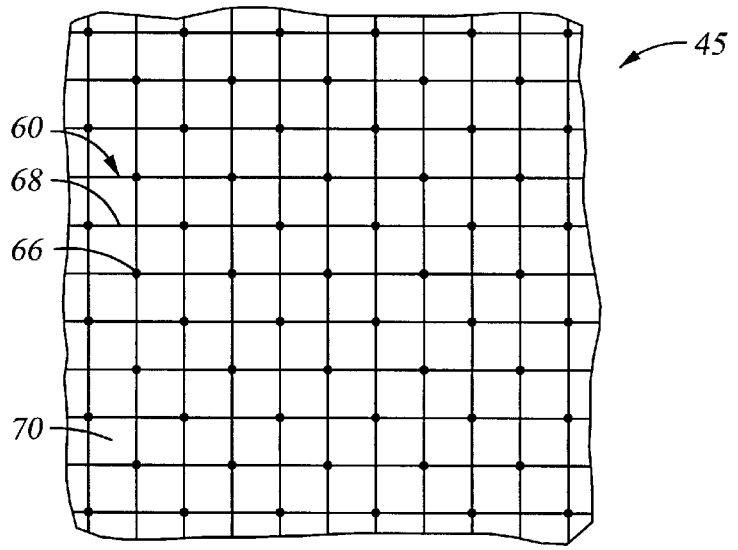
FIG. 9 is a top view of another embodiment of a polishing pad.

The invention contemplates any number of groove and protrusion constructions, whether uniform or random. FIGS. 7–10 are illustrative of embodiments of the invention. Each of the embodiments in FIGS. 7–9 show X-Y oriented grooves having a plurality of protrusions disposed therein to define the groove segments. By increasing the density of protrusions 66, the groove segments 68 are made increasingly smaller, thereby restraining the mobility of fluid within the grooves to a smaller volume. The fluid mobility through the grooves 60 toward the edge of the pad 45 is illustrated in FIGS. 7 and 8 with flow paths 96. As the number of protrusions 66 per unit area increases, the number of available flow paths 96 is reduced. In order to facilitate removal of waste material from the pad surface during polishing, a preferred embodiment provides at least one flow path for fluid to be vented radially outward toward the edge of the pad 45, and ultimately off of the pad 45.

Figure 10:
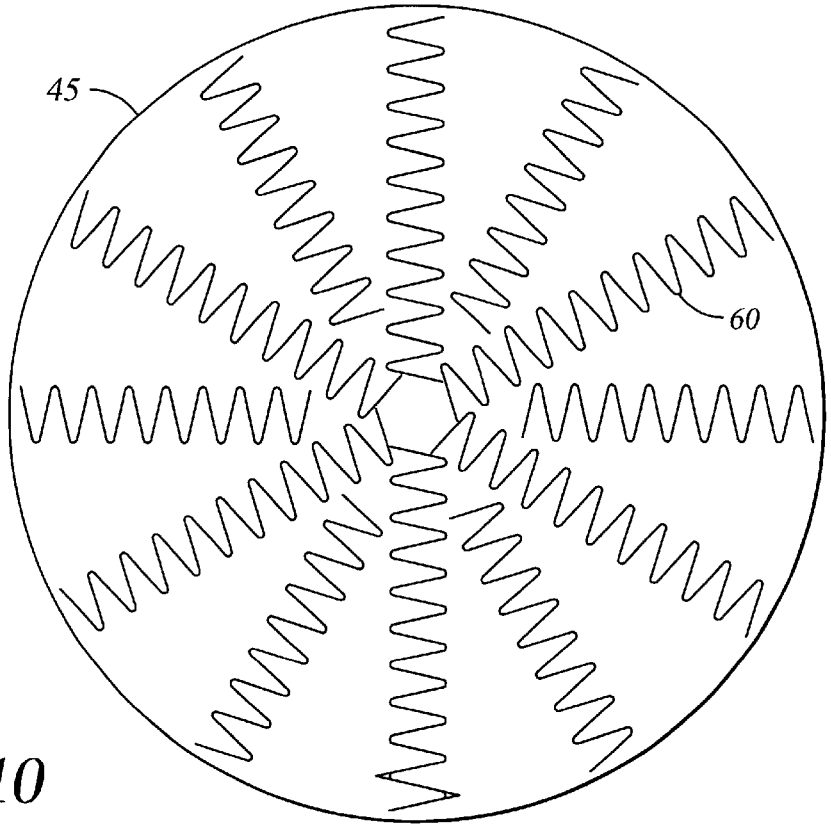
FIG. 10 is a top view of another embodiment of a polishing pad.

The foregoing embodiments provide X-Y grid patterns on the pad surface. However, any groove geometry adapted to restrict the flow of radially flowing fluid through the grooves 60 is contemplated. FIG. 10 shows another embodiment, wherein the grooves 60 comprise a series of sharp turns moving radially outward toward the edge of the pad 45. The grooves 60 define stepped flow paths similar to those in FIGS. 7 and 8 and provide a longer path for the fluid to flow through than would a linear or even curved groove extending to the edge of the pad 45. In addition, each collision with the sidewalls of the grooves 60 at the turns of the grooves 60 absorbs a portion of the fluid's kinetic energy, thereby further inhibiting the flow of the fluid.

Figure 11:
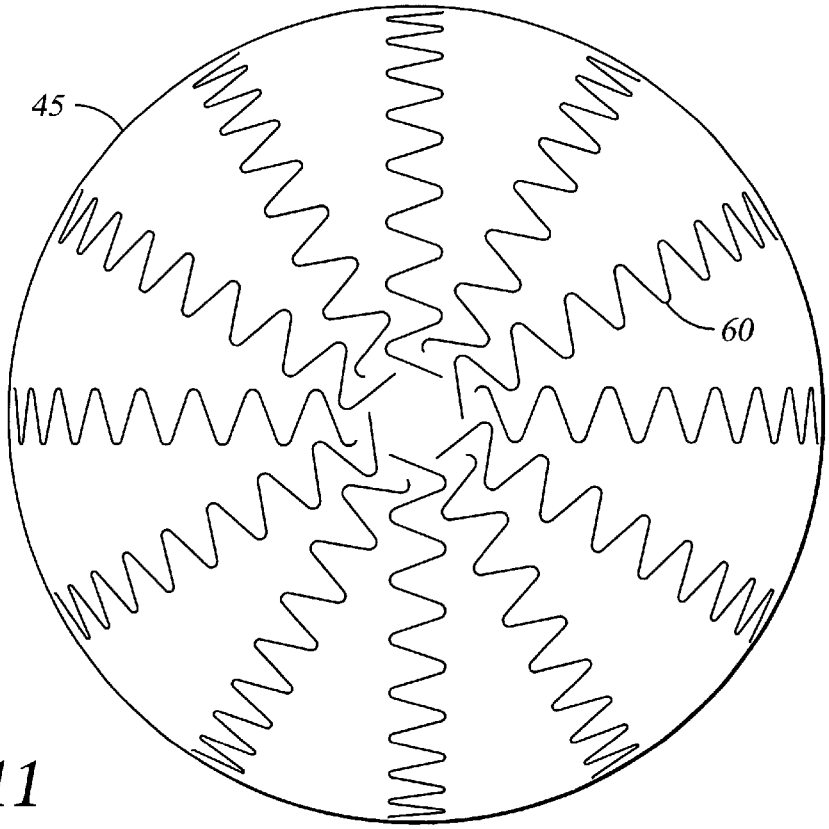
FIG. 11 is a top view of another embodiment of a polishing pad.

In the embodiment of FIG. 10, the segments of each groove 60 are uniformly spaced moving radially outwardly along the groove 60. In another embodiment, the pitch between the curved segments of the grooves 60 may be varied. Thus, for example, in FIG. 11, the groove segments are more closely spaced at an outer portion of the pad 45 relative to an inner portion. Thus, the distance traveled by the fluid per radial unit length is increased at the outer portion.

While the foregoing is directed to the preferred embodiment of the present invention, other and further embodiments of the invention may be devised without departing from the basic scope thereof, and the scope thereof is determined by the claims that follow.

What is claimed is:

1. A polishing pad comprising a plurality of protrusions having an upper polishing surface, wherein a first portion of the protrusions are connected to one another and a second portion of the protrusions are isolated by a plurality of discontinuous fluid-retaining grooves formed on the polishing pad and adapted to restrict the flow of a fluid through the grooves.

2. The polishing pad of claim 1, wherein the grooves are formed inwardly of an edge of the polishing pad.

3. The polishing pad of claim 1, wherein the grooves are selected from arcuate grooves, linear grooves, or any combination thereof.

4. The polishing pad of claim 1, wherein the polishing pad is adapted for use with at least one of a linear polisher and a rotary polisher.

5. The polishing pad of claim 1, wherein the pad comprises a first material and wherein the grooves are non-intersecting and are separated from one another by a second material.

6. The polishing pad of claim 5, wherein the first material and the second material are the same material.

7. The polishing pad of claim 5, wherein the first material and the second material define a polishing surface of the pad.

8. A substrate polishing pad, comprising:

(a) a polishing surface on a first side of the substrate polishing pad; and (b) a plurality of discontinuous fluid-retaining groove segments formed on the first side of the substrate polishing pad and recessed below the polishing surface, wherein the fluid-retaining groove segments are X-Y oriented and are separated from one another by portions of the polishing surface.

9. The substrate polishing pad of claim 8, wherein the fluid-retaining groove segments are disposed inwardly of an edge of the substrate polishing pad.

10. The substrate polishing pad of claim 8, wherein the fluid-retaining groove segments have a pitch between about 700 mils and about 1500 mils.

11. The substrate polishing pad of claim 8, wherein the fluid-retaining groove segments have a depth between about 5 mils and about 100 mils.

12. The substrate polishing pad of claim 8, wherein the fluid-retaining groove segments have a width between about 6 mils and about 80 mils.

13. The substrate polishing pad of claim 8, wherein the substrate polishing pad is adapted for use with at least one of a rotary polisher or a linear polisher.

14. An apparatus for polishing a substrate, comprising:

(a) one or more rotatable platens; and (b) a polishing pad disposed on each of the rotatable platens, and comprising a plurality of discontinuous non-intersecting fluid-retaining groove segments formed on a first side of the polishing pad and recessed below a polishing surface.

15. The apparatus of claim 14, further comprising:

(a) a motor coupled to the rotatable platens; and (b) one or more polishing heads rotatably mounted in facing relation to the rotatable platens.

16. The apparatus of claim 14, wherein the a plurality of fluid retaining groove segments have an X-Y orientation and are separated from one another at their respective ends by portions of the polishing surface.

17. The apparatus of claim 14, wherein the fluid-retaining groove segments have a width between about 6 mils and about 80 mils.

18. The apparatus of claim 14, wherein the fluid-retaining groove segments have a pitch between about 700 mils and about 1500 mils.

19. The apparatus of claim 14, wherein the fluid-retaining groove segments have a depth between about 5 mils and about 100 mils.

20. The apparatus of claim 14, wherein the polishing pad includes a plurality of holes formed through a thickness of the polishing pad from the first surface to a second surface.

21. The apparatus of claim 14, wherein the rotatable platens are part of a chemical mechanical polishing system.

* * * * *

UNITED STATES PATENT AND TRADEMARK OFFICE

CERTIFICATE OF CORRECTION

PATENT NO. : 6,241,596 B1
DATED : June 5, 2001
INVENTOR(S) : Osterheld et al.

It is certified that error appears in the above-identified patent and that said Letters Patent is hereby corrected as shown below:

Column 6,
Line 41, please insert a period after "thereof".

Column 7,
Line 51, please delete "a plurality of protrusions" and add a colon (:) after "comprising".

Lines 52 through 57, please delete "having an upper polishing surface, wherein a first portion of the protrusions are connected to one another and a second portion of the protrusions are isolated by a plurality of discontinuous fluid-retaining grooves formed on the polishing pad and adapted to restrict the flow of a fluid through the grooves".

Line 52, please add -- (a) a plurality of polishing islands defining at least a portion of a polishing surface; -- then go to the next line, please add -- (b) a plurality of protrusions connecting at least some of the plurality of polishing islands; wherein one or more of the plurality of polishing islands and one or more of the protrusions define a plurality of discontinuous fluid-retaining grooves adapted to restrict the flow of a fluid. --.

Line 58, please insert -- discontinuous fluid-retaining -- before "grooves".
Line 60, please insert -- discontinuous fluid-retaining -- before "grooves".

Column 8,
Lines 1 through 4, please replace "The polishing pad of claim 1, wherein the pad comprises a first material and wherein the grooves are non-intersecting and are separated from one another by a second material." with -- A polishing pad, comprising a plurality of polishing islands made of a first material and at least partly defined by a plurality of non-intersecting discontinuous fluid-retaining grooves adapted to restrict the flow of a fluid therethrough and wherein the non-intersecting discontinuous fluid-retaining grooves are separated from one another by the plurality of polishing islands and a second material. --

Line 8, please delete "of the pad".
Line 46, please replace "the a plurality" with -- a plurality --.

UNITED STATES PATENT AND TRADEMARK OFFICE

CERTIFICATE OF CORRECTION

PATENT NO. : 6,241,596 B1
DATED : June 5, 2001
INVENTOR(S) : Osterheld et al.

It is certified that error appears in the above-identified patent and that said Letters Patent is hereby corrected as shown below:

Column 8 cont'd,
Line 64, please add the following claims:

"22. A polishing pad, comprising one or more discontinuous fluid-retaining grooves formed on a first surface of the polishing pad and adapted to restrict the flow of a fluid through the discontinuous fluid-retaining grooves, wherein the discontinuous fluid-retaining grooves define a plurality of islands having an upper polishing surface, wherein at least two of the islands are connected to one another and at least two of the islands are isolated from one another by the discontinuous fluid-retaining groove segments."

"23. The polishing pad of claim 22, wherein the at least two connected islands are connected by protrusions disposed to delimit the discontinuous fluid-retaining grooves."

"24. The polishing pad of claim 23, wherein the plurality of islands are made of a first material and the protrusions are made of a second material different from the first material."

"25. The polishing pad of claim 23, wherein the plurality of islands and the protrusions define a polishing surface."

Signed and Sealed this

Nineteenth Day of November, 2002

*Attest:*

*Attesting Officer*

JAMES E. ROGAN
*Director of the United States Patent and Trademark Office*